US006558070B1

(12) United States Patent
Valtanen

(10) Patent No.: US 6,558,070 B1
(45) Date of Patent: May 6, 2003

(54) PROTECT ARRANGEMENT

(75) Inventor: Jarkko Valtanen, Helsinki (FI)

(73) Assignee: Variform Oy, Helsinki (FI)

( * ) Notice: Subject to any disclaimer, the term of this patent is extended or adjusted under 35 U.S.C. 154(b) by 0 days.

(21) Appl. No.: 09/856,577

(22) PCT Filed: Oct. 1, 1999

(86) PCT No.: PCT/FI99/00809

§ 371 (c)(1),
(2), (4) Date: May 23, 2001

(87) PCT Pub. No.: WO00/30724

PCT Pub. Date: Jun. 2, 2000

(30) Foreign Application Priority Data

Nov. 23, 1998 (FI) ..... 982525

(51) Int. Cl.[7] ..... E01C 5/22
(52) U.S. Cl. ..... 404/35; 404/41
(58) Field of Search ..... 404/17, 18, 31, 404/32, 34, 35, 41; 14/2, 4

(56) References Cited

U.S. PATENT DOCUMENTS

| | | | | | |
|---|---|---|---|---|---|
| 3,339,326 | A | * | 9/1967 | Derr et al. | 52/309 |
| 3,679,531 | A | * | 7/1972 | Wienand et al. | 161/48 |
| 3,685,403 | A | * | 8/1972 | Domnick | 94/13 |
| 3,773,604 | A | * | 11/1973 | Desai et al. | 161/37 |
| 3,870,587 | A | * | 3/1975 | Merrell | 161/37 |
| 4,277,201 | A | * | 7/1981 | Abell | 404/35 |
| 4,568,584 | A | | 2/1986 | Holland | |
| 4,703,597 | A | * | 11/1987 | Eggemar | 52/220 |
| 5,364,204 | A | * | 11/1994 | MacLeod | 404/35 |
| 5,820,798 | A | * | 10/1998 | Staten et al. | 264/45.5 |
| 5,983,584 | A | * | 11/1999 | Staten et al. | 52/309.8 |
| 6,021,646 | A | * | 2/2000 | Burley et al. | 62/235 |
| 6,032,428 | A | * | 3/2000 | Rosan et al. | 52/592.1 |
| 6,082,055 | A | * | 7/2000 | Kelly | 52/71 |
| 6,205,728 | B1 | * | 3/2001 | Sutelan | 52/309.7 |
| 6,455,127 | B1 | * | 9/2002 | Valtanen | 428/137 |

FOREIGN PATENT DOCUMENTS

| | | |
|---|---|---|
| DE | 25 58 967 | 7/1977 |
| WO | WO98/17357 | 4/1998 |
| WO | WO98/46830 | 10/1998 |

* cited by examiner

*Primary Examiner*—Robert E. Pezzuto
*Assistant Examiner*—Kristine Florio
(74) *Attorney, Agent, or Firm*—Swidler Berlin Shereff Friedman, LLP

(57) ABSTRACT

A protective arrangement comprising one or several plane structures such as protective plates or elements, each one of which is meant to be used with one or several similar ones and are removably attached to one another. The structural part is stiffened in proportion to bending and has stiffening ribs. The arrangement is meant for temporarily protecting a field of grass and/or ice. One or several plastic based thermal insulation assemblies are attached to the downward side of the supporting structural part. A supporting structure is formed from the thermal insulation assembly that projects from the downward surface of the stiffening ribs.

27 Claims, 4 Drawing Sheets

PROTECT ARRANGEMENT

Figure 1A:
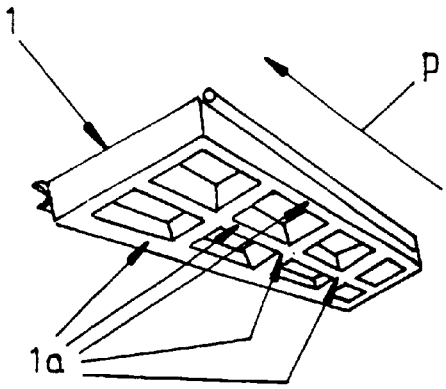

The invention relates to a protective arrangement, that comprises one or several essentially stiff-structured plane structures, such as protective plates, elements or like, each one of which is meant to be used advantageously with one or several similar ones, that are to be attached to each other removably, particularly for covering of ground in order to protect and/or coat the same temporarily and/or for a like purpose. A structural part, that is stiffened particularly in proportion to bending, acts as the plane structure's supporting structure, that has stiffening ribs or like, placed in the longitudinal direction and/or in the crosswise direction or correspondingly.

For the purpose above, particularly for covering a field of grass or e.g. of ice, it is previously known to use separate surface elements, that are to be connected to each other e.g. by quick-release arrangements in order to form a uniform surface. For example covering elements being sold nowadays by the name TERRAPLAS represent particularly more developed solutions, that are made of plastics by injection moulding. The covering element in question has been manufactured as a perforated structure in a way, that not any actual thermal insulation effect may be achieved by the type of covering element. Correspondingly the support arrangement to support the covering elements on the ground must furthermore be attached to the covering elements by means of totally separate auxiliary devices and work stages. In addition to that the locking arrangements connecting the covering elements to each other must also be attached separately, so that a uniform covering may be achieved by the type of covering elements.

On the other hand it is previously known to use e.g. styrox particularly for covering of ice fields, that has been surrounded by both sides of the same by plywood plate. This type of solution is naturally not applicable to be installed as such particularly on a grass field, if not totally separate foot structures are being used to raise the covering structure apart from the ground. On the other hand when being used in connection with an ice field, such problem of this type of solution has been found, that the plywood plates tend to freeze into the ice, that is why loosening of the same is laborious. In addition to that the type of constructions are very heavy, that is why storing as well as use of the same in actual coating is disproportionately difficult.

On the other hand in the Finnish Patent Application number 964199 there has been presented a protective structure, the thermal insulation of which comprises a preferably plastic based, such as cell, cellular, foam plastic structured and/or a like thermal insulation layer, whereby a support arrangement, that is formed of the bottom surface of the same in an essentially built-in manner, comprises a platform structure projecting from the basic wall thickness of the thermal insulation layer, particularly to achieve an air space between the protective structure and the ground under the same.

The solution in question is very advantageous in practice, which is due to the fact, that the thermal insulation existing between the ground and the protective structure gets more efficient particularly thanks to the air space existing between the protective structure and the ground. In this case the feet being formed as a built-in platform structure directly to the bottom surface of the thermal insulation layer first of all prevent so called burning of the grass being left under the protective structure. In the application in question there has been presented furthermore as an advantageous embodiment coupling of the protective structures with each other by means of a joint assembly, that is arranged built-in to the same during manufacturing and that operates e.g. by quick-release principle. The solution being developed in this connection has many advantages in practice, but one disadvantage in practice is such, that when grounds of totally differing type e.g. a grass and an ice surface are being coated, also different kinds of elements must be used, that have differing structures in respect with each other for each respective use. On the other hand when speaking of protective elements to be used in connection with a grass surface, the thermal insulations are very often unnecessary in practice.

It is the aim of the protect arrangement according to this invention to achieve a decisive improvement in the problems presented above and thus to raise substantially the level of knowledge in the field. To achieve this aim, the protect arrangement according to the invention is primarily characterized in, that a protect arrangement, that is meant particularly for temporary protecting of a field of grass and/or of ice, comprises one or several preferably plastic based, such as cell, cellular, foam plastic structured or like thermal insulation assemblies, each one of which is attached or is to be attached at least to the downward side of the supporting structural part and, wherein a supporting structure is formed of the thermal insulation assembly, that projects essentially from the downward surface of the stiffening ribs or the like.

As the most important advantages of the protect arrangement according to the invention may be mentioned easy installation of those surface structures to be formed of the same as well as simplicity of construction and manufacturing of a structure according to the same. Thanks to the invention it is first of all possible to use the same structural part of the protect assembly as an advantageous embodiment as such without the thermal insulation for covering e.g. a field of grass and correspondingly for covering a field of ice, when equipped with a thermal insulation, that may be attached advantageously e.g. by a snap-on-joint to the stiffening ribs existing on the downward surface of the supporting structural part. Furthermore as an advantageous embodiment, the protect arrangement is formed of protective plates, that are coupled with each other on hinge-principle, whereby a coating composition is achieved, that may be easily rolled up. In this connection it is naturally advantageous to exploit furthermore removable couplings in connection with the hinge-joints so, that the plates may as needed be released from each other, whereby replacement e.g. of one separate protective plate with another one is enabled when necessary.

As an advantageous embodiment, to the back part of a supporting structural part being used particularly for covering a field of grass, there has been arranged advantageously a net-like, grate-like, perforated structure or like, which enables ventilation of the grass existing under the protective plate as well as other metabolism of the same. The basic principle of the invention, that a supporting structure is formed of the thermal insulation layer, that extends underneath the supporting structural part and that has when necessary furthermore a platform structure being formed in a certain way, brings out a particularly significant improvement to the comfortability of use for a surface structure entirety being formed of the protective plates. When the stiffening ribs of a protective plate, that is manufactured e.g. by extrusion or injection moulding and that is equipped with stiffening ribs and possibly also with thermal insulations on the downward side, are being placed as usual directly against the ground, direct thermal conduction always takes place from the cold ice surface by the stiffening ribs. This is why an adequate thermal insulation influence may not be achieved by traditional solutions. Thanks to the protect arrangement according to the invention, this problem may be avoided also in such a solution, in which the supporting structure of the thermal insulation does not extend to the point of the ends of the stiffening ribs, in which case there anyhow exists an insulating air space between the ends of the stiffening ribs and the ground.

Figure 1B:
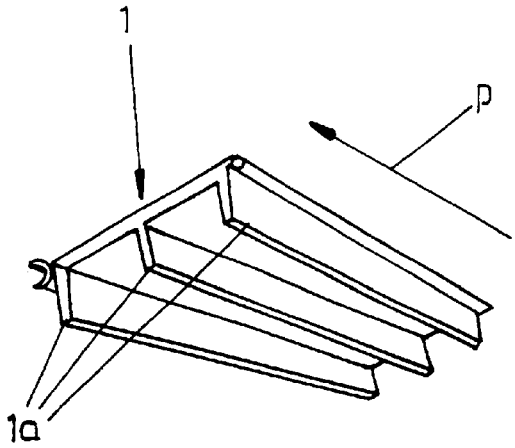
Figure 1C:
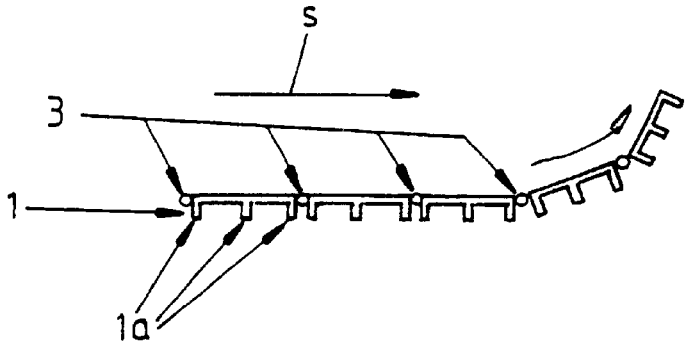
Figure 2A:
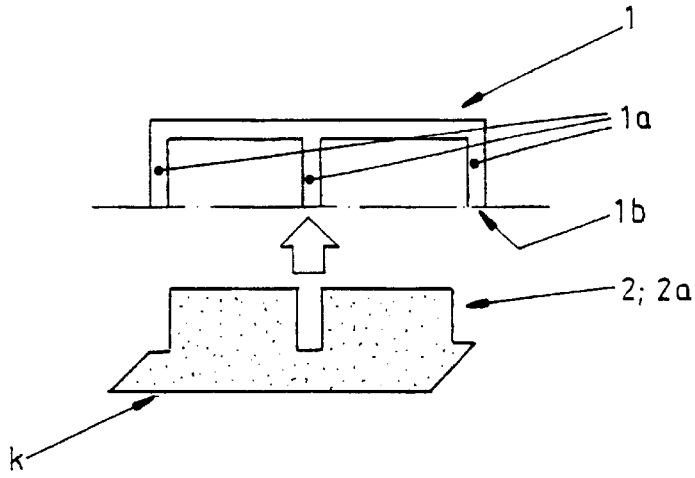
Figure 2B:
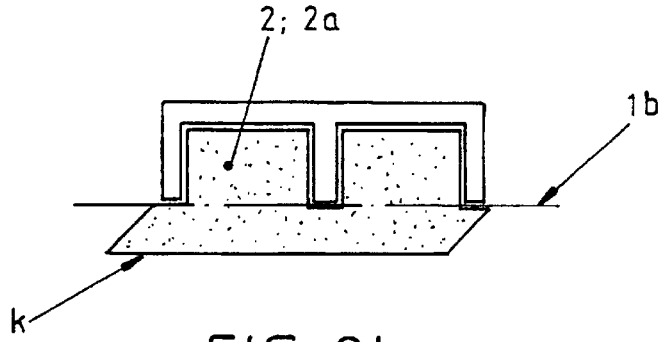
Figure 2C:
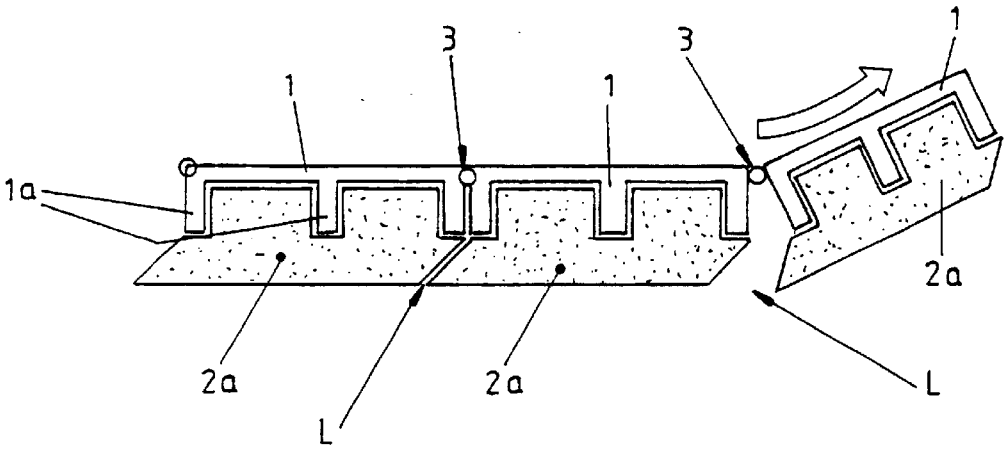
Figures 3A, 3B, 3C:
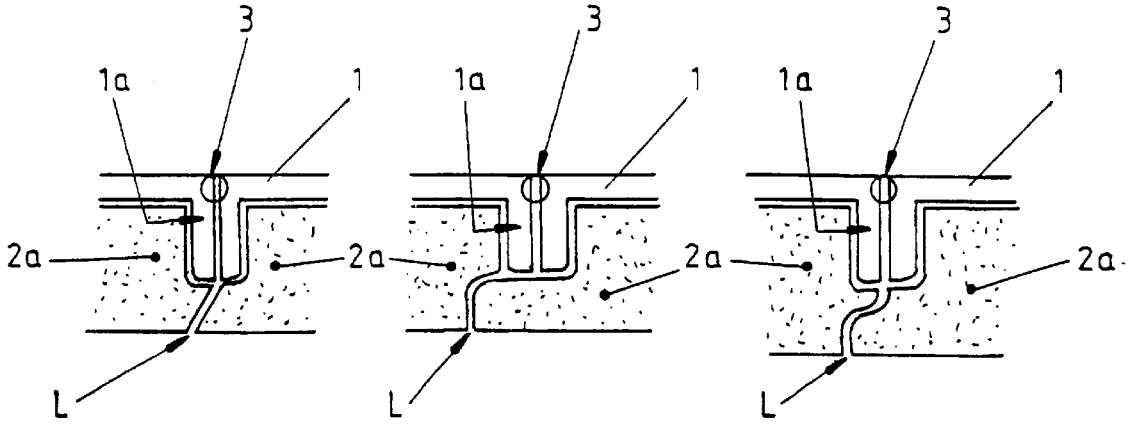
Figure 3D:
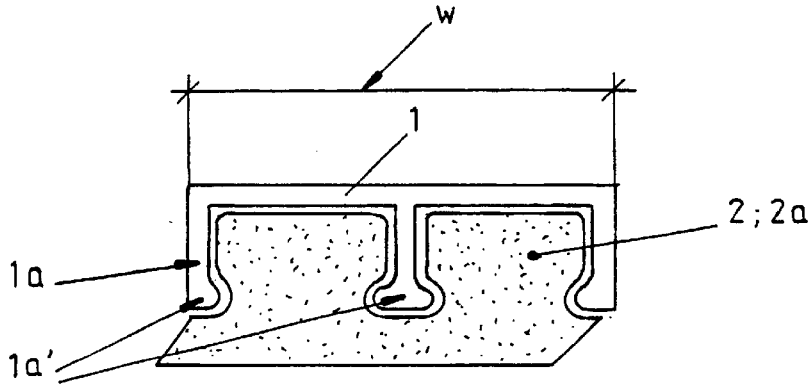
Figure 4A:
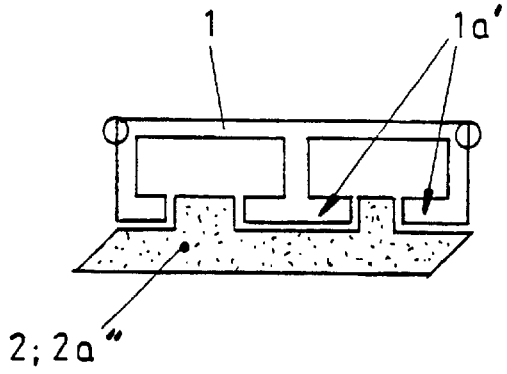
Figure 4B:
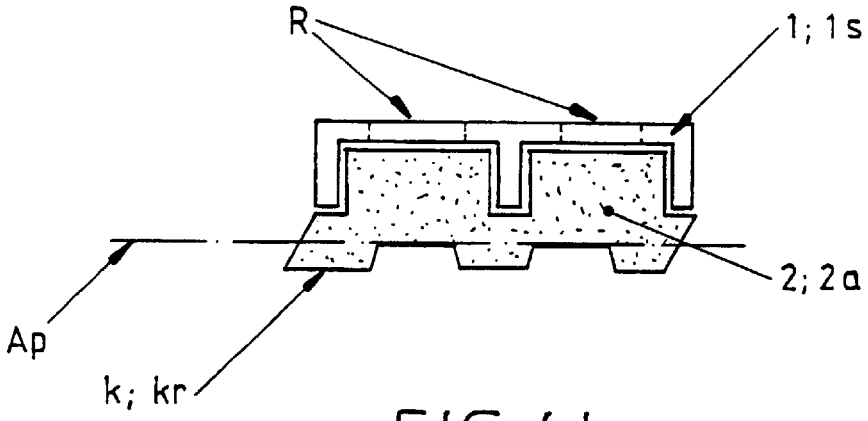
Figure 4C:
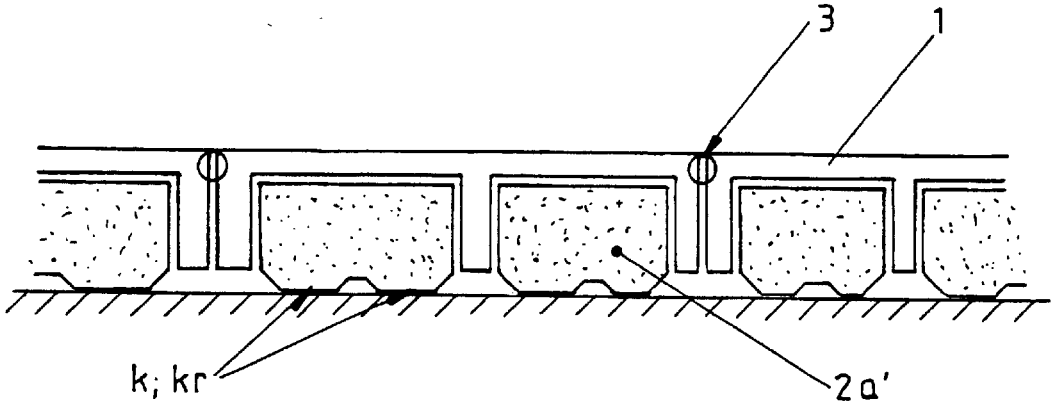

In the following description, the invention is illustrated in detail with reference to the appended drawings, in which FIGS. 1*a* and 1*b* show some supporting structural parts as a perspective view, that are applicable for the protect arrangement according to the invention, FIG. 1*c* shows an advantageous principle for use of the protect arrangement according to the invention, FIGS. 2*a*–2*c* show an advantageous basic composition and operating of a protect arrangement according to the invention, FIGS. 3*a*–3*d* show different kinds of advantageous details being exploited in the protect arrangement and FIGS. 4*a*–4*c* show furthermore some advantageous structures being enabled by the protect arrangement according to the invention.

The invention relates to a protect arrangement, that comprises one or several essentially stiff-structured plane structures, such as protective plates, elements or like, each one of which is meant to be used advantageously with one or several similar ones, that are to be attached to each other removably particularly for covering of ground in order to protect and/or coat the same temporarily and/or for a like purpose. A structural part 1, that is stiffened particularly in proportion to bending, acts as the plane structure's supporting structure, that has stiffening ribs 1*a* or like placed in the longitudinal direction s and/or in the crosswise direction p or correspondingly. A protect arrangement, that is meant particularly for temporary protecting of a field of grass and/or of ice, comprises one or several preferably plastic based, such as cell, cellular, foam plastic structured or like thermal insulation assemblies 2, each one of which is attached or is to be attached at least to the downward side of the supporting structural part 1 and, wherein a supporting structure k is formed of the thermal insulation assembly 2, that projects essentially from the downward surface 1*b* of the stiffening ribs 1*a* or the like.

As an advantageous embodiment the thermal insulation assembly 2 is first of all arranged as a thermal insulation piece 2*a*, 2*a*', 2*a*", that is to be fastened removably in connection with the structural part 1 and that is uniform, when viewed in a cross section as shown in the drawings, and, that is to be supported between two or several successive stiffening ribs la or like of the supporting structural part According to those advantageous embodiments shown particularly e.g. in FIGS. 2*c*, 3*a*–3*d* or 4, the coupling of the thermal insulation piece 2; 2*a*, 2*a*" with the following thermal insulation piece, is carried out by fitting joints L, that exist underneath the stiffening ribs 1*a* of two adjacent supporting structural parts 1. In the presented views, the fitting joint L is arranged to deviate essentially from the vertical direction, that is carried out by inclined, angulated, arched or like counterpart surfaces of the thermal insulation piece.

As shown particularly in FIGS. 1*c*, 2*c*, 3*a*–3*c* and 4, each supporting structural part 1 is connected to another one by a hinge 3, a joint or correspondingly, in order to achieve a uniform entirety, that is to be rolled up or to be put together correspondingly. In this connection the thermal insulation assembly 2 of each supporting structural part 1 is carried out by a thermal insulation piece 2*a*, 2*a*", that is connected removably to the structural part 1 and, that has essentially the same width w as the same except the solution shown in FIG. 4*c*, in which the dimensions of each thermal insulation piece 2*a*' corresponds essentially to the space being left between two successive stiffening ribs.

Furthermore as shown in FIGS. 3*d* and 4*a*, to the lower edges of the stiffening ribs 1*a* of the supporting structural part 1 there has been arranged an additional grip assembly 1*a*', such as a transverse projection or like, onto which the thermal insulation 2, such as the thermal insulation piece 2*a*, 2*a*" is supported. The thermal insulation piece 2*a* shown particularly in FIG. 3*d*, is arranged to get locked on quick-release principle, such as by a snap-on-joint or correspondingly to the transverse projections 1*a*' existing at the ends of the stiffening ribs of the supporting structural part 1. Correspondingly a thermal insulation piece 2*a*" has been used in the embodiment shown in FIG. 4*a*, which leaves the internal spaces between the stiffening ribs of the structural part 1 essentially empty.

In the embodiments represented above the thermal insulation assembly 2, such as the thermal insulation piece 2*a*, 2*a*', 2*a*" of the protect arrangement, consists advantageously of EPS-material, such as expanded polystyrene foam, styrox or like, XPS-material, such as extruded polystyrene foam, EPP-material, such as expanded polyprophylene foam, extruded polyethylene foam or extruded PVC-structural foam sheet.

In FIGS. 4*b* and 4*c* there has been shown protect arrangements, that are meant particularly for covering of a field of ice. In this case the downward surface of the thermal insulation assembly 2, such as the thermal insulation piece 2*a*, 2*a*', is formed as a platform structure kr particularly in order to achieve an isolating layer of air between the surface of ice and the lower edges 1*b* of the stiffening ribs 1*a* and/or the downward surface Ap of the thermal insulation assembly 2.

Furthermore as an advantageous embodiment, the supporting structural part 1 of the protect arrangement according to the invention may be applied in such a way, that the back part 1*s* of the supporting structural part is equipped as shown in FIG. 4*b* with holes R or as a net-like, grate-like structure or like, particularly for ventilation or like of the grass surface existing under the supporting structural part 1, that is being used particularly without the thermal insulation assembly. In this connection it is naturally possible to optimize e.g. the size of the holes in a way, that the same supporting structural part, that is equipped with thermal insulation, may be exploited also in connection with a field of ice. On the other hand despite the perforation of the back part, the thermal insulation is not, however, harmed considerably in this connection with a view to the thermal insulation capacity of the thermal insulation piece.

It is obvious, that the invention is not limited to the embodiments presented or described above, but it can be modified within the basic idea even to a great extent. In this connection it is naturally possible to equip the protect arrangement according to the invention more abudantly by exploiting e.g. different kinds of supporting assemblies or by extra stiffening plates etc. or by corresponding surface structures or internal structures. In this connection, the supporting structural parts belonging to the protect arrangement according to the invention may be fastened differing from the hinge-joint type of solutions shown above also by other kinds of solutions or by certain kinds of jointing pieces, that connect e.g. the thermal insulation pieces with each other. It is naturally possible to use different kinds of coatings in order to coat either the uppermost or lowermost surface or the supporting structural part. Correspondingly it is possible to form the supporting structural part belonging to the protect arrangement of most heterogeneous materials such as of metallic or e.g. composite or ceramic structures and even of wood.

What is claimed is:

1. A surface covering protective structure, comprising:

at least one stiff structured plane structure operable to cover a protected surface, each plane structure comprising:

at least one stiffened supporting part comprising plastic-based material, the stiffened support part comprising a plurality of stiffening ribs, and at least one thermal insulation supporting part removably connected to at least a portion of a downward side of the stiffened supporting part, wherein the thermal insulation supporting part is removably fastenable to the stiffened supporting part, wherein the thermal insulation part extends to a lower level than the stiffening ribs to engage the protected surface, and wherein the thermal insulation supporting part is supported between at least two successive stiffening ribs.

2. The protective structure according to claim 1, wherein the stiffening ribs are arranged at least one of in a longitudinal direction and a transverse direction.

3. The protective structure according to claim 1, wherein the protect arrangement is operable to temporarily protect a field of at least one of grass and ice.

4. The protective structure according to claim 1, wherein the thermal insulation supporting part is plastic based.

5. The protective structure according to claim 4, wherein the thermal insulation supporting part comprises cell, cellular, or foam plastic.

6. The protective structure according to claim 4, wherein the stiffened supporting part is extruded or injection molded.

7. The protective structure according to claim 1, wherein the thermal insulation supporting part has a uniform cross-section.

8. The protective structure according to claim 1, comprising a plurality of plane structures.

9. The protective structure according to claim 8, further comprising:

a connecting structure operable to removably attach adjacent plane structures to each other.

10. The protective structure according to claim 8, further comprising:

a fitting joint operable to couple adjacent thermal insulation supporting parts to each other.

11. The protective structure according to claim 1, wherein the thermal insulation supporting part has a width substantially similar to the width of the stiffened supporting part.

12. The protective structure according to claim 1, wherein the thermal insulation supporting part comprises EPS-material, styrox, XPS-material, EPP-material.

13. The protective structure according to claim 12, wherein the EPS-material comprises expanded polystyrene foam.

14. The protective structure according to claim 12, wherein the XPS-material comprises extruded polystyrene foam.

15. The protective structure according to claim 12, EPP-material comprises expanded polypropylene foam, extruded polyethylene foam or extruded PVC-structural foam sheet.

16. The protective structure according to claim 1, wherein the protective structure is operable to cover a field of ice and further comprises:

a platform structure extending from a downward surface of the thermal insulation supporting part wherein the platform structure is operable to achieve an isolating layer of air between a surface of the ice and lower edges of the stiffening ribs and/or a downward surface of the thermal insulation supporting part.

17. The protective structure according to claim 1, wherein the protective structure is operable to cover a field of grass and further comprises:

vents in the stiffened supporting part operable to ventilate a grass surface under the protective structure.

18. The protective structure according to claim 17, wherein the vents comprise holes, a net-like or grate-like structure.

19. A surface covering protective structure, comprising:

a plurality of stiff structured plane structure operable to cover a protected surface, each plane structure comprising:

at least one stiffened supporting part comprising a plurality of stiffening ribs, and at least one thermal insulation supporting part removably connected to at least a portion of a downward side of the stiffened supporting part, wherein the thermal insulation part extends to a lower level than the stiffening ribs to engage the protected surface;

a connecting structure operable to removably attach adjacent plane structures to each other; and a fitting joint operable to couple adjacent thermal insulation supporting parts to each other.

20. The protective structure according to claim 19, wherein the fitting joint are arranged underneath the stiffening ribs of two adjacent stiffened supporting parts.

21. The protective structure according to claim 19, wherein the fitting joint is not vertical when viewed in a cross section.

22. The protective structure according to claim 21, wherein the fitting joint comprises inclined, angled, or arched counterpart surfaces on adjacent thermal insulation supporting parts.

23. The protective structure according to claim 19, wherein the connecting structure comprises a hinge or joint operable to connect adjacent stiffened supporting parts and permit the structure to be rolled up.

24. A surface covering protective structure, comprising:

at least one stiff structured plane structure operable to cover a protected surface, each plane structure comprising:

at least one stiffened supporting part comprising a plurality of stiffening ribs, and at least one thermal insulation supporting part removably connected to at least a portion of a downward side of the stiffened supporting part, wherein the thermal insulation part extends to a lower level than the stiffening ribs to engage the protected surface; and a grip assembly arranged at lower edges of the stiffening ribs, wherein the grip assembly is operable to engage and retain the thermal insulation supporting part.

25. The protective structure according to claim 24, wherein the grip assembly comprises a transverse projection.

26. The protective structure according to claim 24, wherein the grip assembly and the thermal insulation supporting part form a quick-release.

27. The protective structure according to claim 26, wherein the quick-release comprises a snap-on-joint including transverse projections on the stiffening ribs and detents on the thermal insulation supporting parts, wherein the detents engage the projections.

* * * * *